US011536259B2

(12) United States Patent
Ikushima

(10) Patent No.: US 11,536,259 B2
(45) Date of Patent: Dec. 27, 2022

(54) LIQUID MATERIAL EJECTION DEVICE

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 314 days.

(21) Appl. No.: 16/070,367

(22) PCT Filed: Jan. 11, 2017

(86) PCT No.: PCT/JP2017/000639
§ 371 (c)(1),
(2) Date: Jul. 16, 2018

(87) PCT Pub. No.: WO2017/122683
PCT Pub. Date: Jul. 20, 2017

(65) Prior Publication Data

US 2019/0022692 A1 Jan. 24, 2019

(30) Foreign Application Priority Data

Jan. 16, 2016 (JP) ..... JP2016-006701

(51) Int. Cl.
*B05B 17/06* (2006.01)
*B05C 11/10* (2006.01)
(Continued)

(52) U.S. Cl.
CPC ..... *F04B 43/046* (2013.01); *B05B 17/0653* (2013.01); *B05C 5/0225* (2013.01);
(Continued)

(58) Field of Classification Search
CPC . B05C 5/0237; B05C 5/0225; B05C 11/1034; B05B 17/0653; F04B 9/00; F04B 9/04; F04B 17/003; F04B 43/046
See application file for complete search history.

(56) References Cited

U.S. PATENT DOCUMENTS 4,022,166 A * 5/1977 Bart ..... F02M 47/02 239/584
4,769,569 A 9/1988 Stahlhuth
(Continued)

FOREIGN PATENT DOCUMENTS

DE 202008007991 U1 8/2008
JP 2002-282740 A 10/2002
(Continued)

OTHER PUBLICATIONS

Supplementary European Search Report having a date of completion of Aug. 1, 2019, issued in counterpart EP Application No. 17738437.7. (1 pages).
(Continued)

*Primary Examiner* — Christopher R Dandridge
(74) *Attorney, Agent, or Firm* — WHDA, LLP

(57) ABSTRACT

A liquid material ejection device in which a plunger is efficiently accelerated. The device includes a liquid chamber communicating with an ejection port and being supplied with a liquid material, a plunger including a tip portion having a smaller diameter than the liquid chamber and is moved in the liquid chamber, an elastic member urging the plunger upward, an arm disposed in a state extending in a substantially horizontal direction, an arm driver serving as a driving source to operate the arm, and a base member on which the arm driver is disposed. The device further includes a rocking mechanism unit connected to the arm driver and rockingly supporting the arm, the arm driver includes a plurality of actuators, the arm includes a pressing
(Continued)

portion pressing the plunger downward, the plunger is pressed by the pressing portion, and the plunger is linearly reciprocated with rocking motion of the arm.

19 Claims, 8 Drawing Sheets

(51) Int. Cl.

| | |
|---|---|
| ***F04B 17/00*** | (2006.01) |
| ***F04B 43/04*** | (2006.01) |
| ***F04B 9/00*** | (2006.01) |
| ***B05C 5/02*** | (2006.01) |
| ***F04B 9/04*** | (2006.01) |

(52) U.S. Cl.
CPC ..... *B05C 5/0237* (2013.01); *B05C 11/1034* (2013.01); *F04B 9/00* (2013.01); *F04B 9/04* (2013.01); *F04B 17/003* (2013.01)

(56) References Cited

U.S. PATENT DOCUMENTS

| | | | | |
|---|---|---|---|---|
| 5,791,339 | A * | 8/1998 | Winter | A61M 16/209 128/204.19 |
| 7,134,617 | B2 | 11/2006 | Ikushima | |
| 7,225,790 | B2 * | 6/2007 | Bartunek | F02M 65/005 123/294 |
| 9,789,512 | B2 | 10/2017 | Ikushima | |
| 2013/0026197 | A1 * | 1/2013 | Felix | B05C 5/0237 222/504 |
| 2013/0048759 | A1 * | 2/2013 | Aguilar | B05C 11/1034 239/562 |
| 2014/0209626 | A1 | 7/2014 | Dunlap et al. | |
| 2014/0263688 | A1 * | 9/2014 | Doyle | B05C 5/0225 239/1 |
| 2015/0300748 | A1 | 10/2015 | Hong et al. | |
| 2015/0367376 | A1 | 12/2015 | Doyle et al. | |
| 2016/0339470 | A1 | 11/2016 | MacIndoe et al. | |

FOREIGN PATENT DOCUMENTS

| | | | | | |
|---|---|---|---|---|---|
| JP | 2010-227866 | A | | 10/2010 | |
| JP | 4786326 | B2 | | 10/2011 | |
| JP | 2011-230122 | A | | 11/2011 | |
| JP | 2015-51399 | A | | 3/2015 | |
| JP | WO2015034083 | | * | 3/2015 | B05B 1/083 |
| KR | 10-1059746 | B1 | | 8/2011 | |
| KR | 101301107 | | * | 8/2013 | F04B 35/04 |
| KR | 101301107 | B1 | | 8/2013 | |
| KR | 1020150102229 | | * | 9/2015 | F04B 43/04 |
| KR | 101581420 | B1 | | 12/2015 | |

OTHER PUBLICATIONS

International Preliminary Report on Patentability (Form PCT/IPEA/409) issued in counterpart International Application No. PCT/JP2017/000639 dated Jun. 7, 2018. (4 pages).

International Search Report dated Apr. 4, 2017, issued in counterpart International Application No. PCT/2017/000639. (3 pages).

Office Action dated Oct. 27, 2020, issued in counterpart KR Application No. 10-2018-7019688, with English translation (12 pages).

Office Action dated Nov. 15, 2021, issued in counterpart EP application No. 17 738 437.7. (5 pages).

* cited by examiner

LIQUID MATERIAL EJECTION DEVICE

TECHNICAL FIELD

The present invention relates to a liquid material ejection device including a plunger reciprocated in a liquid chamber that is in communication with a nozzle, actuators, and a displacement magnifying mechanism, and further relates to an application apparatus incorporating the liquid material ejection device. The term "plunger" used in this Description includes bar-shaped members called a needle, a rod, and a piston, for example.

BACKGROUND ART

Until now, various techniques have been proposed to eject a small amount of liquid material in the form of a droplet by using a plunger reciprocated in a liquid chamber that is in communication with a nozzle. In many cases, an actuator utilizing a motor, air, or a piezoelectric element, for example, is used as a driving source to move the plunger. As an example of ejection devices utilizing air pressure as the driving source, Patent Document 1 applied by the present applicant discloses an ejection device in which an ejection port is opened by operating a plunger rod to move backward with the air pressure, and a liquid droplet is ejected from the ejection port by operating the plunger rod to move forward with elastic force of a spring.

In the ejection device in which the plunger is reciprocated using the spring and the air pressure, a sufficient movement distance of the plunger can be easily obtained. However, because air has compressive properties, it is difficult to increase a reciprocating speed of the plunger to a certain level or higher. On the other hand, in the case of using the piezoelectric actuator, because operation of the piezoelectric element can be controlled in accordance with an electrical pulse signal, the plunger has high stroke reproducibility, and the operation of the piezoelectric element is easy to control.

As an example of ejection devices in which a needle is reciprocated using the piezoelectric actuator as the driving source, Patent Document 2 discloses a liquid material ejection device including a liquid chamber communicating with an ejection port and being supplied with a liquid material, the needle having a tip portion that is moved back and forth in the liquid chamber, a driver operating the needle back and forth, and a displacement magnifying mechanism, the liquid material ejection device ejecting a flying droplet from the ejection port. The driver is constituted by an even number of driving units arranged in a bilaterally symmetric relation, and the displacement magnifying mechanism includes an elastically movable U-shaped member having a lower portion to which the needle is coupled. The needle is moved backward by the driving units applying force to move both ends of the U-shaped member away from each other, and the needle is moved forward by the driving units applying force to move both the ends of the U-shaped member closer to each other.

With the liquid material ejection device using the needle (plunger), because large ejection force can be given by the plunger moving forward at a high speed, it is possible to eject, as a droplet, a liquid material having high viscosity, which cannot be ejected using an ink jet device that pushes and ejects ink in an ink chamber with the aid of the piezoelectric element (piezo element).

Patent Document 3 discloses a droplet ejection device including a casing that has an ejection hole formed at its tip end and has a cylinder bore, a multilayered piezoelectric element disposed within the casing, and a plunger that is driven by the piezoelectric element serving as a driving source, and that is accommodated in the cylinder bore to be finely extendable and contractible, wherein the piezoelectric element is integrally fitted to an element holder and has a rectangular parallelepiped shape, a thin-wall elastic portion is formed in part of the element holder to give the piezoelectric element restoration force on the contraction side, an upper end portion of the element holder is fixed to the casing, and the plunger is formed at a lower end of the element holder.

The device disclosed in Patent Document 3 is a device including the plunger with the same diameter as the cylinder bore and operating based on the ejection principle of ejecting a liquid material in the same amount as a volume of the cylinder bore, which has reduced with forward movement of the plunger. However, the device operating based on that ejection principle is not suitable for high-speed continuous ejection of several hundred shots per second because sliding friction generates between a lateral peripheral surface of the plunger and an inner peripheral surface of the cylinder bore.

CITATION LIST

Patent Documents

Patent Document 1: Japanese Patent Laid-Open Publication No. 2002-282740

Patent Document 2: Japanese Patent Laid-Open Publication No. 2015-51399

Patent Document 3: Japanese Patent No. 4786326

SUMMARY OF INVENTION

Technical Problem

Recently, in an ejection device (dispenser) in which a plunger is reciprocated, it has been demanded to eject a smaller flying droplet than in the past. In the device disclosed in Patent Document 2, for example, the needle having a relatively small diameter is reciprocated within the liquid chamber having a relatively large diameter, and the liquid material can be ejected in a smaller amount than a volume of the liquid chamber, which has reduced with forward movement of the needle. In order to eject a very small flying droplet with the above-mentioned ejection method, the plunger has to be accelerated at speed of a certain level or higher.

In the ejection device in which the plunger is reciprocated by the piezoelectric actuator, a displacement magnifying mechanism for magnifying a displacement of the piezoelectric actuator is needed to obtain the movement distance necessary for accelerating the plunger. However, when the center of gravity of the ejection device is positioned at a higher level with the provision of the displacement magnifying mechanism, problems arise in that wobbling and vibration increase which are generated at the times of not only starting and stopping movement of an application head to which the ejection device is mounted, but also changing a moving speed and a moving direction of the application head.

On the other hand, it is also conceivable to increase a displacement of the piezoelectric element with intent to increase the displacement of the piezoelectric actuator itself. However, using the piezoelectric element of a multilayered structure or using many piezoelectric elements leads to the problem that the size of the ejection device is increased and the manufacturing cost is pushed up.

Furthermore, it is demanded in the ejection device that an ejection portion has satisfactory maintainability. For instance, the ejection device including the ejection portion, which has a structure easy to wash the ejection port clogged with the solidified liquid material and to replace the worn plunger, is demanded.

Accordingly, an object of the present invention is to provide a liquid material ejection device in which a plunger can be efficiently accelerated, the center of gravity of the device can be positioned at a lower level, and satisfactory maintainability can be obtained, and an application apparatus incorporating the liquid material ejection device.

Solution to Problems

The liquid material ejection device according to the present invention comprises a liquid chamber communicating with an ejection port and being supplied with a liquid material, a plunger including a tip portion that has a smaller diameter than the liquid chamber and is moved back and forth in the liquid chamber, an elastic member urging the plunger upward, an arm disposed in a state extending in a substantially horizontal direction, an arm driver serving as a driving source to operate the arm, and a base member on which the arm driver is disposed, wherein the liquid material ejection device further comprises a rocking mechanism unit connected to the arm driver and rockingly supporting the arm, the arm driver includes a plurality of actuators disposed in a longitudinal direction of the arm, the arm includes a pressing portion pressing the plunger downward, the plunger includes a contact portion pressed by the pressing portion, and the plunger is linearly reciprocated with rocking motion of the arm.

In the above liquid material ejection device, the plurality of actuators may be each constituted by a multilayered piezoelectric element, the arm may be moved upward when the actuator disposed on the side nearer to the pressing portion is brought into an extended state and the actuator disposed on the side farther away from the pressing portion is kept in a non-extended state or brought into a contracted state, and the arm may be moved downward when the actuator disposed on the side nearer to the pressing portion is kept in the non-extended state or brought into the contracted state and the actuator disposed on the side farther away from the pressing portion is brought into the extended state.

In the above liquid material ejection device, the plurality of actuators may be constituted by an even number of actuators. Preferably, the even number of actuators may be constituted by a first piezoelectric actuator and a second piezoelectric actuator.

In the above liquid material ejection device, the pressing portion or the contact portion may have a curved surface allowing a contact state between the pressing portion and the contact portion to be maintained following the rocking motion of the arm.

The above liquid material ejection device may further comprise a fastener detachably supporting the arm to the base member. Preferably, the fastener is disposed between the plurality of actuators, and the plurality of actuators are tightly sandwiched between the arm and the base member by the fastener.

The above liquid material ejection device may further comprise a guide supporting the plunger movably in a vertical direction, the elastic member may be a compressed coil spring urging the plunger upward at all times, and the plunger may be detachably inserted through the elastic member and the guide.

In the above liquid material ejection device, the rocking mechanism unit may be connected to a lower end of the arm driver, or may be connected to an upper end of the arm driver.

In the above liquid material ejection device, the rocking mechanism unit may include a first rocking mechanism unit connected to a lower end of the arm driver and a second rocking mechanism unit connected to an upper end of the arm driver.

In the above liquid material ejection device, the rocking mechanism unit may include a connection portion connected to one end of the arm driver, and a support portion rockingly supporting the connection portion. Preferably, the support portion has a convex or concave support surface that is formed by a smooth curved surface, and the connection portion has a concave or convex sliding surface that slides along the support surface of the support portion.

In the above liquid material ejection device, the pressing portion may be constituted by a pressing member detachably attached to the arm.

The application apparatus according to the present invention comprises the above-described liquid material ejection device, a worktable on which an application target is placed, a relatively moving device that moves the liquid droplet ejection device and the application target relatively to each other, and a liquid material supply source that supplies a liquid material to the liquid material ejection device.

In the above application apparatus, the liquid material ejection device may be constituted by a plurality of liquid material ejection devices.

Advantageous Effect of Invention

According to the present invention, the liquid material ejection device can be obtained in which the plunger can be efficiently accelerated, the center of gravity of the device can be set at a lower level, and satisfactory maintainability can be obtained. The application apparatus incorporating the liquid material ejection device can also be obtained.

DESCRIPTION OF EMBODIMENTS

The present invention is concerned with a liquid material ejection device for accurately ejecting a minute amount of liquid material ranging from the type having low viscosity, such as water, a solvent, or a reagent, to the type having high viscosity, such as a solder paste, a silver paste, or an adhesive. Exemplary embodiments of the present invention will be described below.

Example 1

<Constitution>

Figure 1:
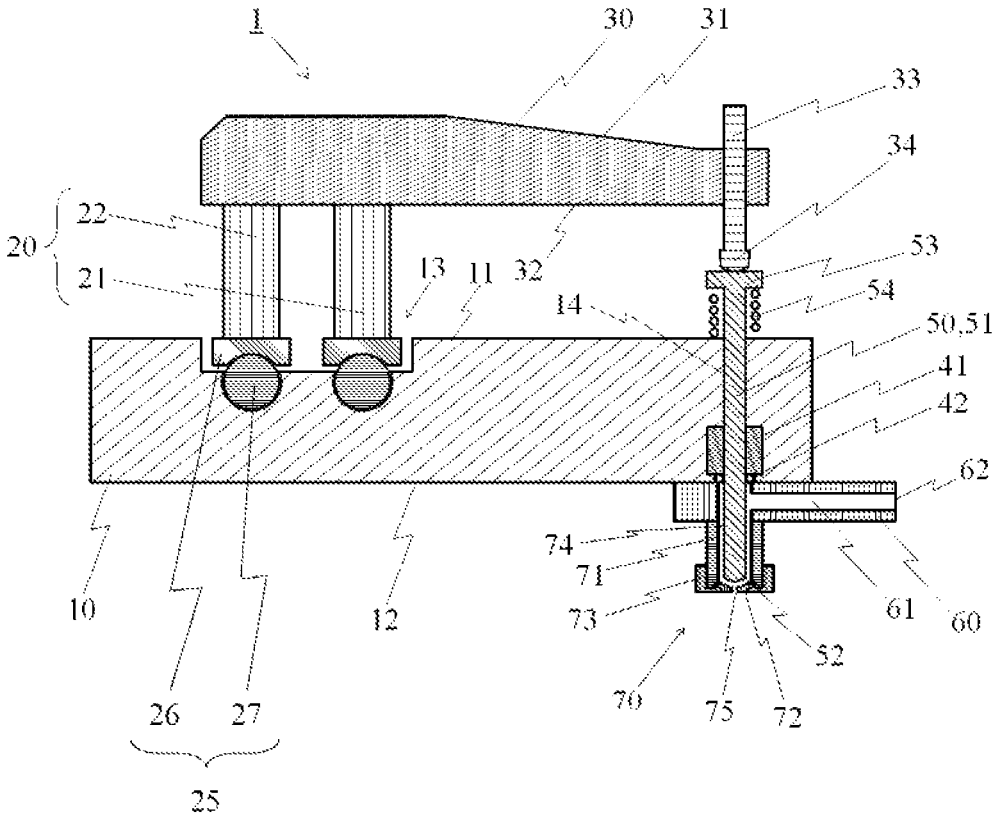
FIG. 1 is a side sectional view of a liquid material ejection device according to Example 1.

FIG. 1 is a side sectional view of a liquid material ejection device 1 according to Example 1.

The liquid material ejection device 1 according to Example 1 represents a jet-type ejection device including, as main components, a base member 10, an arm driver 20, an arm 30, a plunger 50, a liquid feed member 60, and a nozzle unit 70, and ejecting a liquid material in the form of a flying droplet.

For convenience of explanation, the side closer to the nozzle unit 70 is called the "lower side", the side closer to the arm 30 is called the "upper side", the side closer to the nozzle unit 70 (right side in FIG. 1) is called the "front side", and the side closer to the arm driver 20 (left side in FIG. 1) is called the "rear side" in some cases.

The base member 10 is a block-like member having an upper surface 11 where the rocking mechanism unit 25 is disposed, and a bottom surface 12 to which the nozzle unit 70 is mounted.

A most part of the upper surface 11 is a horizontal flat surface. A recess 13 in which the rocking mechanism unit 25 is disposed, and an upper opening of a plunger insertion hole 14 are formed in the upper surface 11. A pair of support portions 27 constituting the rocking mechanism unit 25 is disposed in the recess 13. Details of the rocking mechanism unit 25 will be described in detail later.

It is to be noted that the recess 13 and the plunger insertion hole 14 are not always required to be formed in the same member. Thus, the base member 10 may be constituted by a plurality of members.

The arm driver 20 is constituted by a first actuator 21 and a second actuator 22, which are disposed side by side in a longitudinal direction of the arm 30. The first actuator 21 and the second actuator 22 are formed of two piezoelectric elements (piezo elements) that have the same specifications, and that are extended and contracted in a lamination direction (up-down direction in FIG. 1) upon application of voltage. The actuators (21, 22) in this Example are each a bar-shaped multilayered element that is constituted, for example, by laminating a piezoelectric ceramic material having a high distortion rate, an inner electrode, an outer electrode, and an insulator. Each actuator has a thickness of about 5 to 100 mm, for example, and a displacement amount of about 5 to 100 μm, for example, in a thickness direction. Although two actuators are used in this Example, the number of actuators is not limited to two, and three or more (preferably, even number) of actuators may be arranged in an opposing relation. A displacement of the actuator (21, 22) is transmitted to the plunger 50 after being magnified 3 to 100 times (preferably 5 to 50 times), for example, through the arm 30.

Figure 2:
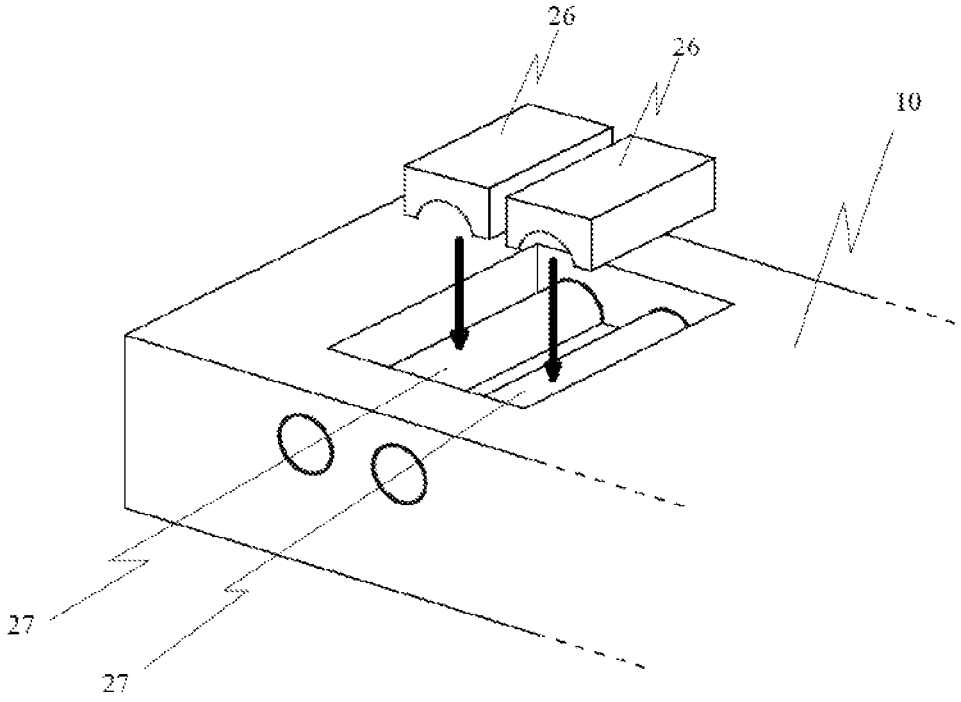
FIG. 2 is a schematic perspective view of a rocking mechanism unit according to Example 1.

FIG. 2 is a schematic perspective view of the rocking mechanism unit 25 according to Example 1.

The rocking mechanism unit 25 includes connection portions (26, 26) joined to lower ends of the actuators (21, 22) in a one-to-one relation, and the support portions (27, 27) disposed in the recess 13 of the base member 10.

The two connection portions 26 are members each having, in its lower surface, a recess defined by a smooth curved surface (i.e., a semispherical dent), and are disposed side by side in a longitudinal direction of the base member 10.

Each support portion 27 in this Example is constituted by a pillar-like member that is fixedly supported in a state inserted into a through-hole formed to extend from one lateral surface to the other lateral surface of the base member 10. An upper surface of the support portion 27 is formed by a smooth curved surface (i.e., a semispherical projection) having a curvature equal to or smaller than that of the recess of the connection portion 26. Unlike this Example, the connection portion 26 may include the projection, and the support portion 27 may include the recess.

In the rocking mechanism unit 25, the connection portions 26 are caused to slide and move in the longitudinal direction of the arm 30, whereby the arm driver 20 and the arm 30 can be inclined relative to the base member 10. Furthermore, because shearing deformations of the actuators (21, 22) can be absorbed by the rocking mechanism unit 25, it is possible to stabilize rocking motion of the arm 30, and to increase ejection accuracy.

The arm 30 is an elongate member extending in a substantially horizontal direction (including the case in which an angle relative to a horizontal plane is not more than 30 degrees). The arm 30 is tightly supported to the base member 10 directly or indirectly using fasteners (not illustrated) such that a flat bottom surface 32 is parallel to the upper surface 11 of the base member 10. The arm 30 is made of a less-flexible hard material, such as a metal, and it serves to transmit driving force of the arm driver 20 to the plunger 50 directly. Because the arm 30 is apart from the base member 10 only by a distance corresponding to the height of the arm driver 20, the center of gravity of the ejection device 1 can be positioned at a lower level.

The arm 30 has a length larger than at least a distance by which the arm driver 20 is caused to extend, and functions as a displacement magnifying mechanism for magnifying displacement amounts of the actuators (21, 22). A stroke can also be dynamically adjusted by controlling the displacement amounts of the actuators (21, 22) and making the arm 30 inclined at a desired angle relative to the base member 10.

A through-hole is formed in a front portion of the arm 30, and an arm rod 33 constituting a pressing member is inserted into the through-hole to be tightly supported there. A pressing portion 34 having a projected shape is formed at a lower end of the arm rod 33. The arm rod 33 is detachably fixed to the arm 30, and can be easily replaced with another one. A contact position and a contact angle of the pressing portion 34 relative to a rear end portion 53 of the plunger vary depending on a vertical position of the pressing portion 34. Therefore, the pressing portion 34 is preferably constituted such that a surface of the pressing portion 34 opposing to the rear end portion 53 has a shape (such as a semispherical or semi-ellipsoidal shape) providing a curved surface. The pressing member is not always required to be a rod-like member, and it may be, for example, a block-like member including a projected portion that is formed at its lower end and is detachably fixed to the arm 30.

The arm 30 performs rocking motion with a point near the arm driver 20 serving as a fulcrum, and the pressing portion 34 comes into contact with the rear end portion 53 of the plunger, thereby causing the plunger 50 to move forward at high speed. Because the arm rod 33 and the plunger 50 are constituted by separable different members as described above, the number of components of the displacement magnifying mechanism can be reduced, and the center of gravity of the ejection device 1 can be positioned at a lower level.

The plunger 50 includes a rod portion 51 that is constituted by a rod-like member extending straightforward in the vertical direction, a tip portion 52 having a semi-ellipsoidal shape, and a rear end, portion 53 that is constituted by a disk-shaped member having a larger diameter than the rod portion 51. The plunger 50 is made of, for example, a metal material, a ceramic material, or a resin material having high corrosion resistance.

The rod portion 51 of the plunger is inserted through not only an elastic member 54 constituted by a compressed coil spring, but also a ring-shaped guide 41 and a ring-shaped sealing member 42 both disposed in the plunger insertion hole 14. Although the arm 30 is rockingly moved along an arc-shaped locus and comes into contact with the rear end portion 53 of the plunger, an operation direction of the plunger 50 is restricted to become linear with the aid of the guide 41. The guide 41 may be constituted by a plurality of members arranged in the form of a ring.

The tip portion 52 of the plunger is arranged in a liquid chamber 74 having a larger diameter than the rod portion 51, and is reciprocated without contacting an inner peripheral surface of the liquid chamber 74. Thus, the tip portion 52 of the plunger can be moved at high speed because it is reciprocated without causing sliding friction. The tip portion 52 of the plunger may have any suitable shape. For example, a flat shape, a spherical shape, or a shape having a boss formed at a tip end is disclosed herein as the shape of the tip portion 52.

The rear end portion 53 of the plunger has a larger diameter than the elastic member 54 and is always urged upward by the elastic member 54. The rear end portion 53 of the plunger is positioned to face the pressing portion 34 of the arm, and it constitutes a contact portion that is held in contact with the pressing portion 34. When the pressing portion 34 of the arm pushes the rear end portion 53 downward by pressure in excess of urging force of the elastic member 54, inertial force is applied to the liquid material positioned forward of the tip portion 52 of the plunger 50, and a smaller amount of the liquid material than a volume displaced by the tip portion 52 is ejected in the form of a droplet. When the pressing portion 34 of the arm is ascended, the plunger 50 is also ascended by the urging force of the elastic member 54, and a maximum ascended position (i.e., a stroke) is specified by the pressing portion 34 of the arm.

Since the rear end portion 53 of the plunger is not coupled to the pressing portion 34, the plunger 50 can be easily removed from the plunger insertion hole 14. In other words, it is possible to easily perform an operation of replacing the plunger 50 that is a consumable component.

While, in this Example, the forward movement of the plunger 50 is stopped by seating the tip portion 52 of the plunger against a valve seat 72 that is constituted by an inner bottom surface of the liquid chamber 74, another example in which the tip portion 52 is not seated against the valve seat is also included in the technical concept of the present invention.

The liquid feed member 60 is a member extending in the horizontal direction along the base member 10, and is detachably attached to the lower surface 12 of the base member. A supply passage 61 is formed inside the liquid feed member 60. One end of the supply passage 61 is communicated with the liquid chamber 74, and the other end of the supply passage 61 is communicated with a supply port 62. Since the liquid chamber 74 is arranged near a front end of the ejection device 1, a length of the supply passage 61 is shorter than those in other known ejection devices, and a wasted amount of the liquid material is relatively small.

A reservoir is connected to the supply port 62 via a liquid feed pipe (including a tube-like member). The liquid material in the reservoir is pressurized by compressed gas, and is supplied to the liquid chamber 74 via the supply passage 61. When the liquid material has high fluidity, the inside of the reservoir is not needed to be pressurized.

The nozzle unit 70 includes a nozzle member 71, the valve seat 72, and a cap 73.

The nozzle member 71 is a cylindrical member in which the liquid chamber 74 is formed. The valve seat 72 and the cap 73 are disposed in a tip portion of the nozzle member 71.

The valve seat 72 is a disk-shaped member having an ejection port 75 that is formed at a center of the valve seat 72 to be opened downward, and the valve seat 72 is fixed in place by screwing the cap 73 over a tip portion of the nozzle member 71. Respective center lines of the liquid chamber 74, the ejection port 75, and the plunger 50 are arranged to lie on one straight line. With the plunger 50 seating against and departing away from the valve seat 72, the discharge port 75 is closed and opened, whereby the liquid material is ejected. The liquid chamber 74 is filled with the liquid material up to a level near the sealing member 42, and the liquid material is prevented from coming into the guide 41 with the presence of the sealing member 42.

The nozzle unit 70 may be provided with a temperature control mechanism for heating the liquid material in the liquid chamber 74 to a predetermined temperature.

<Operation>

(1) Neutral Position

FIG. 1 represents a state in which the actuators (21, 22) are in an inoperative mode and the arm 30 is in a neutral position. In this state, the tip portion 52 of the plunger rod is in a state not contacting the valve seat 72, and the ejection port 75 is opened. The rear end portion 53 of the plunger rod is in a state contacting the pressing portion 34 of the arm rod by the urging action of the elastic member 54.

In the neutral position, the tip portion 52 and the valve seat 72 may be contacted with each other unlike the example illustrated in FIG. 1. In the case of holding the tip portion 52 and the valve seat 72 in the contact state, the liquid material can be prevented from leaking through the ejection port.

(2) Ascended Position

Figure 3:
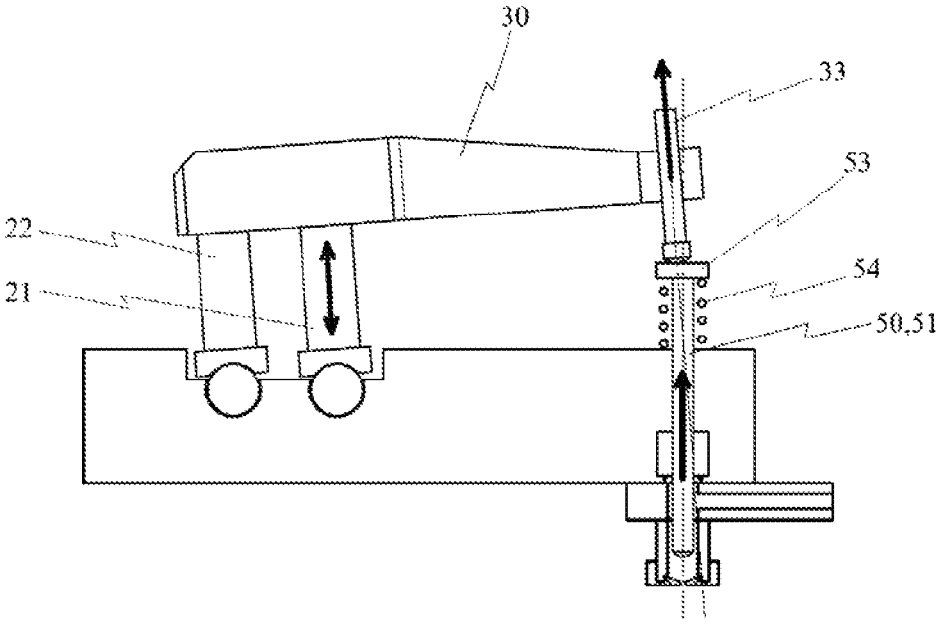
FIG. 3 is a side sectional view of the liquid material ejection device (in an ascended position) according to Example 1.

FIG. 3 represents a state in which the first actuator 21 is operated and the arm 30 is in an ascended position.

When the first actuator 21 is supplied with electric power to be displaced forward (namely, to increase its overall length), the arm rod 33 is moved upward on the basis of the principle of leverage. The second actuator 22 is not supplied with electric power and is maintained at the same position as that in the neutral position. At that time, the connection portions 26 and 26 of both the actuators are moved over and around the support portions 27 and 27, respectively, and the first actuator 21 and the second actuator 22 are inclined rearward (leftward in FIG. 3). Unlike the above operation, a contraction signal may be applied to the second actuator 22 such that the second actuator 22 is displaced to contract and a greater displacement is given to the pressing portion 34 and the plunger 50.

When the arm rod 33 is moved upward, the plunger 50 is also moved upward by the urging action of the elastic member 54, whereby the pressing portion 34 of the arm rod and the rear end portion 53 of the plunger are kept in the contact state. While the arm rod 33 is moving upward, the pressing portion 34 and the rear end portion 53 of the plunger are not necessarily kept in the contact state at all times, and they may come into the contact state after being temporarily brought into a non-contact state.

When the arm rod 33 is moved upward, the pressing portion 34 is moved upward along an arc-shaped locus about a center positioned on the side including the actuators (21, 22). On the other hand, the plunger 50 is moved upward linearly by the action of the guide 41. Thus, when the arm rod 33 is moved upward, discrepancy occurs in positional relation between the pressing portion 34 and the rear end portion 53 of the plunger. To cope with such discrepancy, in this Example, a lower surface of the pressing portion 34 is constituted by a curved surface, such as a spherical surface, to ensure the appropriate contact state between the pressing portion 34 and the rear end portion 53 of the plunger. Unlike the illustrated example, an upper surface of the rear end portion 53 of the plunger may be constituted by a curved surface, such as a spherical surface, and the lower surface of the pressing portion 34 may be constituted by a flat surface (or a curved surface).

It is also important that the rear end portion 53 of the plunger may be formed in such a size as allowing the rear end portion 53 to follow the locus of the pressing portion 34.

(3) Descended Position

Figure 4:
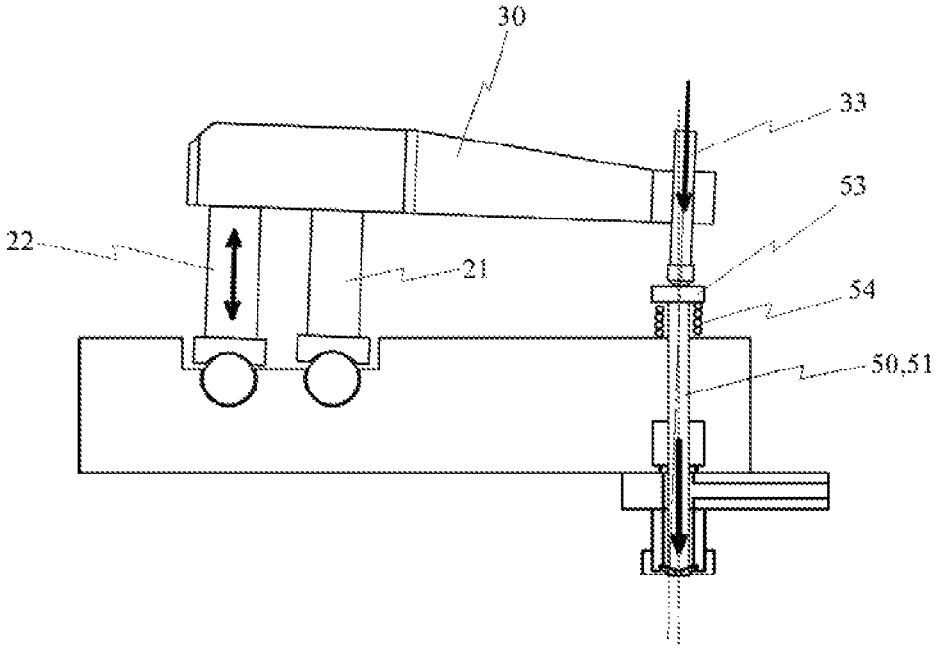
FIG. 4 is a side sectional view of the liquid material ejection device (in a descended position) according to Example 1.

FIG. 4 represents a state in which the first actuator 21 is returned to the neutral position, the second actuator 22 is operated, and the arm 30 is in a descended position.

When the supply of electric power to the first actuator 21 is stopped and the second actuator 22 is supplied with electric power to be displaced forward (namely, to increase its overall length), the arm rod 33 is moved downward on the basis of the principle of leverage. At that time, the connection portions 26 and 26 of both the actuators are moved over and around the support portions 27 and 27, respectively, and the first actuator 21 and the second actuator 22 are inclined forward (rightward in FIG. 4). Unlike the above operation, a contraction signal may be applied to the first actuator 21 such that the first actuator 21 is displaced to contract and a greater displacement is given to the pressing portion 34 and the plunger 50.

When the arm rod 33 is moved downward, the pressing portion 34 of the arm presses the rear end portion 53 of the plunger by force in excess of the urging force of the elastic member 54. Accordingly, the plunger 50 is moved downward and the tip portion 52 is seated against the valve seat 72, thereby causing the liquid material to be ejected in the form of a droplet through the ejection port 75. While the arm rod 33 is moving downward, the pressing portion 34 and the rear end portion 53 of the plunger are not necessarily kept in the contact state at all times, and they may come into the contact state after being temporarily brought into a non-contact state.

As in the case of above (2), the arm rod 33 is moved downward along an arc-shaped locus, and the plunger 50 is moved downward linearly by the action of the guide 41.

By repeating the above-described operations, the actuators (21, 22) are rockingly moved to the right and the left in a continuous way, and the plunger 50 is reciprocated at a frequency of, for example, 100 to 500 times or more per second. From the viewpoint of increasing ejection accuracy, the oscillation frequency of a pulse signal applied to the actuators (21, 22) is preferably kept constant.

<Application Apparatus>

Figure 5:
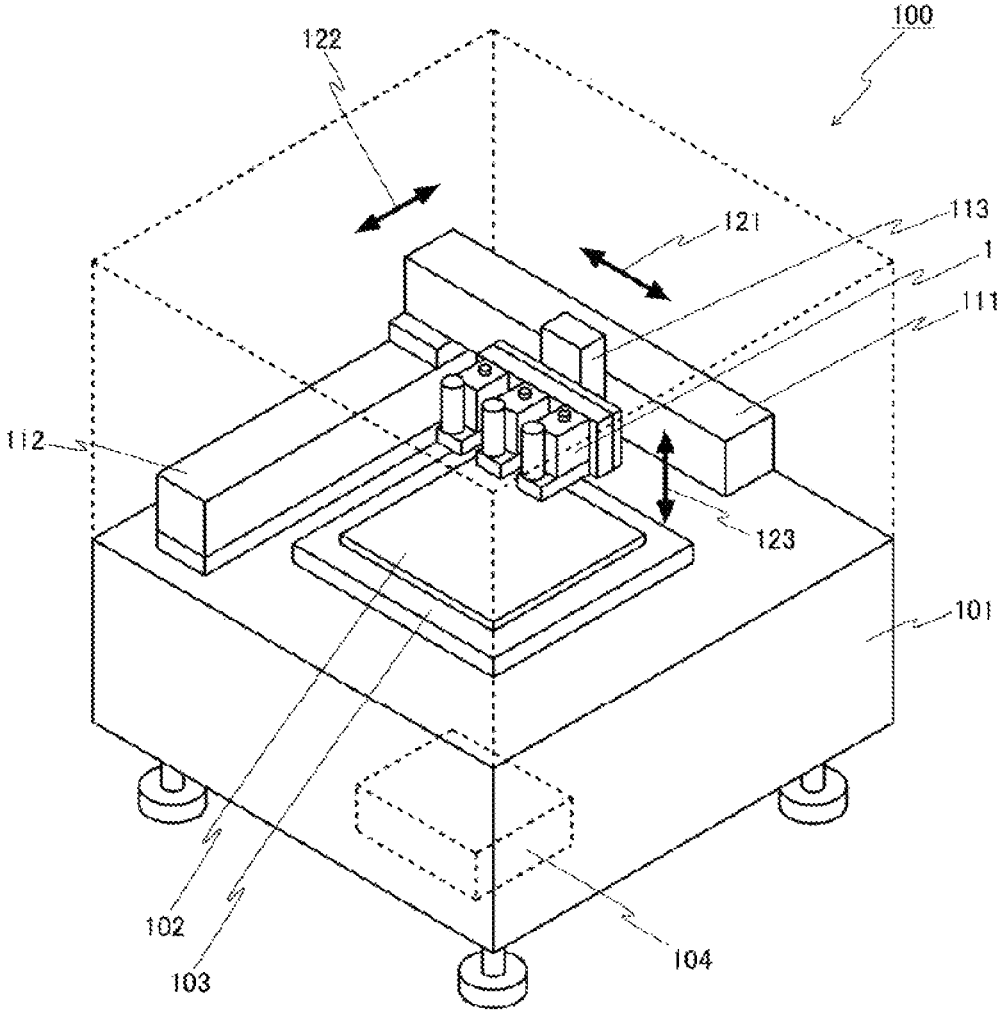
FIG. 5 is a perspective view of an application apparatus incorporating the liquid material ejection device according to Example 1.

As illustrated in FIG. 5, the liquid material ejection device 1 accommodated in a casing and connected to a reservoir (syringe) is mounted to an application head of an application apparatus 100, and is used in work for applying the liquid material onto a workpiece while the application head (ejection device 1) and a worktable 103 are moved relatively to each other using XYZ-axis drivers (111, 112, 113). The illustrated application apparatus 100 includes a bench 101, the worktable 103 on which a workpiece 102, i.e., an application target, is placed, an X-axis driver 111 for relatively moving the liquid material ejection device 1 and the worktable 103 in an X direction 121, a Y-axis driver 112 for relatively moving the liquid material ejection device 1 and the worktable 103 in a Y direction 122, a Z-axis driver 113 for relatively moving the liquid material ejection device 1 and the worktable 103 in a Z direction 123, a not-illustrated dispense controller (ejection control unit) for supplying compressed gas from a compressed gas source (not illustrated) to the reservoir under desired conditions, and an application operation control unit 104 for controlling operations of the XYZ-axis drivers (111, 112, 113). In the application apparatus 100, as denoted by dotted lines, a space above the bench is preferably covered with a cover to prevent particles and dust from reaching the workpiece 102.

The XYZ-axis drivers (111, 112, 113) include, for example, known XYZ-axis servo motors and ball screws, and are able to move the ejection port of the liquid material ejection device 1 to an any desired position of the workpiece at any desired speed. While FIG. 5 illustrates the case in which the three liquid material ejection devices 1 are incorporated in the application apparatus, the number of liquid material ejection devices to be incorporated is not limited to three, the liquid material ejection device 1 may be incorporated singularly or in another plural number such as 2, 4 or more. Furthermore, while FIG. 5 illustrates the case in which the three liquid material ejection devices 1 are mounted to one Z-axis driver 113, the Z-axis driver may be disposed in the same number (three in the example illustrated in FIG. 5) such that the individual liquid material ejection devices 1 can be moved in the Z direction (and the X direction) independently of one another.

With the liquid material ejection device 1 according to Example 1 described above, since the center of gravity of the ejection device 1 is positioned at a lower level to be able to suppress wobbling and vibration of the application head, the application head can be moved at higher speed. Moreover, since the driving force generated by the arm driver 20 is directly transmitted to the plunger 50 through the arm 30 made of a hard material, stroke reproducibility is high, and the liquid material having high viscosity can also be ejected.

Example 2

A liquid material ejection device 1 according to Example 2 is a jet-type ejection device for ejecting the liquid material in the form of a flying droplet as in Example 1. In the following, different points from Example 1 will be primarily described, and description of the same constitution is omitted.

Figure 6:
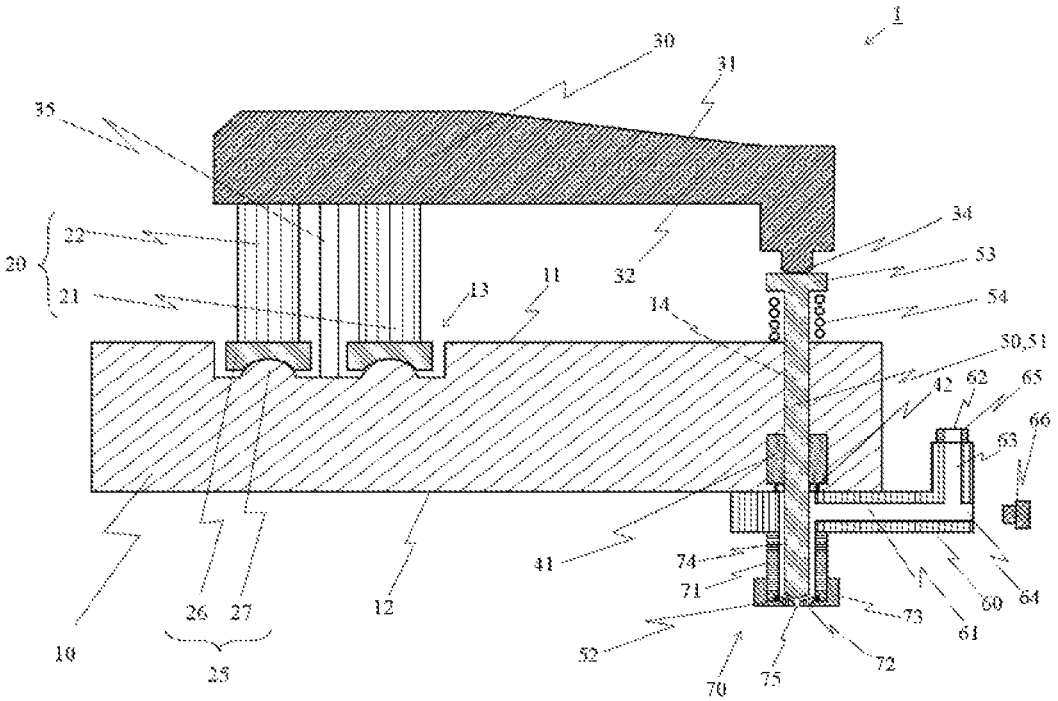
FIG. 6 is a side sectional view of a liquid material ejection device according to Example 2.

FIG. 6 is a side sectional view of the liquid material ejection device 1 according to Example 2.

In this Example, the arm 30 is tightly supported to the base member 10 by inserting a fastener 35, which includes a disk-like member formed at its back end, into a through-hole (not illustrated) formed in a rear portion of the arm 30. The fastener 35 has a length set to support the arm 30 in a state appropriately pressing the arm driver 20. In other words, the first actuator 21 and the second actuator 22 are tightly sandwiched between the arm 30 and the base member 10.

A pair of support portions 27 is formed on a bottom surface of the recess 13 in the base member. Thus, in this Example, the pair of support portions 27 is formed integrally with the base member 10. A threaded hole (not illustrated) used for fixing the fastener 35 is formed between the pair of support portions 27. The fastener 35 having a rod-like shape is provided with a threaded groove formed in its tip portion, and is fixedly screwed into the threaded hole in the recess 13. The fastener 35 is detachably fixed to the threaded hole in the recess 13 such that it can be easily replaced when the lifetime of the arm driver 20 has expired.

The liquid feed member 60 is a member having a substantially L-like shape when viewed from side, and includes a joint 65 having a supply port 62 formed at its upper end. A reservoir (syringe) storing the liquid material is connected to the joint 65 directly or via a liquid feed pipe (including a tube-like member).

A supply passage 61, an inflow passage 63, and an air purging passage 64 are formed in the liquid feed member 60. When the liquid material is initially supplied through the joint 65, air remaining in the individual passages is discharged from an opening formed at an end of the air purging passage 64. After the remaining air has been discharged, the liquid feed member 60 is used in a state in which the air purging passage 61 is closed by a closing plug 66. Since the individual components (61 to 65) of the liquid feed member 60 are, arranged to lie on a straight line, the ejection device 1 can be constituted in a slim width (in a direction perpendicular to the drawing sheet of FIG. 6).

The operation of the liquid material ejection device 1 according to this Example is similar to that in Example 1.

Similar operational effects to those in Example 1 can also be realized with the above-described liquid material ejection device 1 according to Example 2.

Example 3

A liquid material ejection device 1 according to Example 3 is a jet-type ejection device for ejecting the liquid material in the form of a flying droplet as in Example 1. In the following, different points from Example 1 will be primarily described, and description of the same constitution is omitted.

Figure 7:
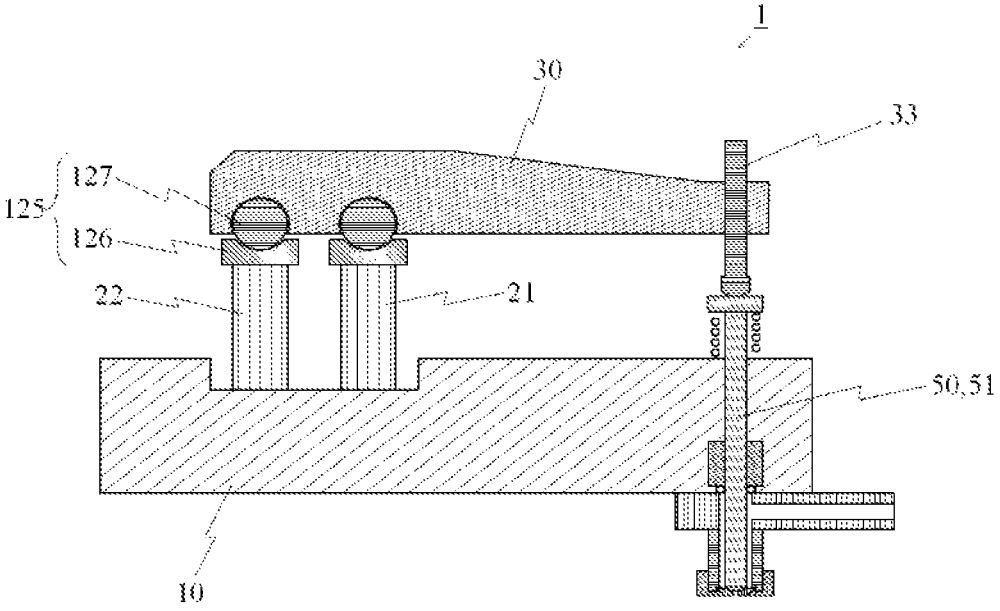
FIG. 7 is a side sectional view of a liquid material ejection device according to Example 3.

FIG. 7 is a side sectional view of the liquid material ejection device 1 according to Example 3.

The liquid material ejection device 1 according to Example 3 is different from Example 1 in that a rocking mechanism unit 125 is disposed at upper ends of the actuators (21, 22). In other words, the rocking mechanism unit 125 is arranged between the actuators (21, 22) and the arm 30.

Connection portions 126 and 126 and support portions 127 and 127 constituting the rocking mechanism unit 125 are similar to the connection portions 26 and the support portions 27 in Example 1 except for positions where those portions are arranged. As in Example 1, each connection portion 126 is a member including a recess formed in its upper surface and defined by a curved surface, and is reciprocated while sliding along a lower surface of the support portion 127 opposing to the relevant connection portion 126.

While, in this Example, the rocking mechanism unit 125 is disposed only at the upper ends of the actuators (21, 22), the rocking mechanism unit 25 in Example 1 may be additionally disposed at the lower ends of the actuators (21, 22). In other words, the rocking mechanism unit may be disposed at each of the upper and lower ends of the actuators (21, 22). With such a constitution, shearing deformations of the actuators (21, 22) can be more reliably absorbed by the two rocking mechanism units.

The operation of the liquid material ejection device 1 according to this Example is similar to that in Example 1.

Similar operational effects to those in Example 1 can also be realized with the above-described liquid material ejection device 1 according to Example 3.

Example 4

A liquid material ejection device 1 according to Example 4 is a jet-type ejection device for ejecting the liquid material in the form of a flying droplet as in Example 2 (FIG. 6). In the following, different points from Example 2 will be primarily described, and description of the same constitution is omitted.

Figure 8:
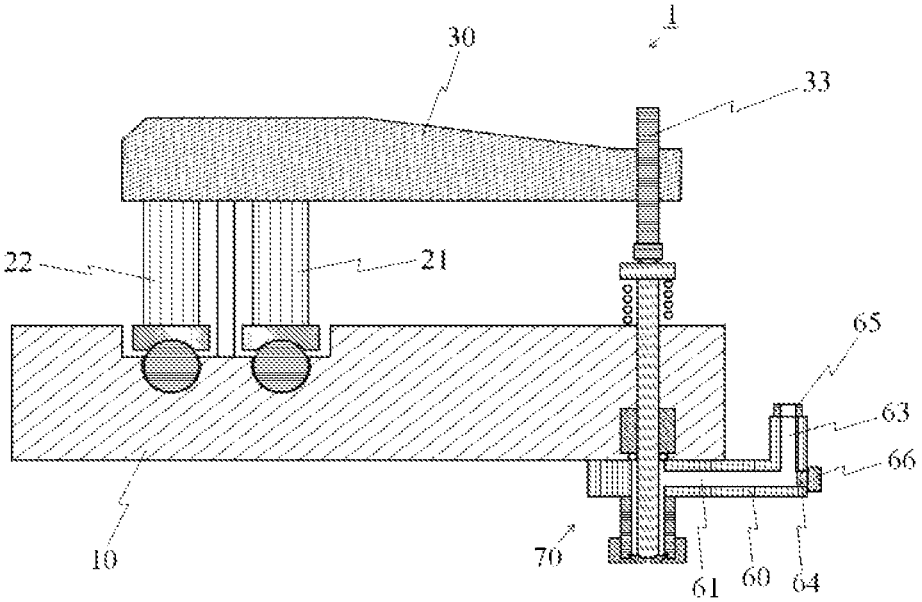
FIG. 8 is a side sectional view of a liquid material ejection device according to Example 4.

FIG. 8 is a side sectional view of the liquid material ejection device 1 according to Example 4.

The liquid material ejection device 1 according to Example 4 is different from Example 2 in that the arm rod 33 is provided. The other constitution is similar to that in Example 2.

Similar operational effects to those in Example 2 can also, be realized with the above-described liquid material ejection device 1 according to Example 4.

Example 5

A liquid material ejection device 1 according to Example 5 is a jet-type ejection device for ejecting the liquid material in the form of a flying droplet as in Example 1. In the following, different points from Example 1 will be primarily described, and description of the same constitution is omitted.

Figure 9:
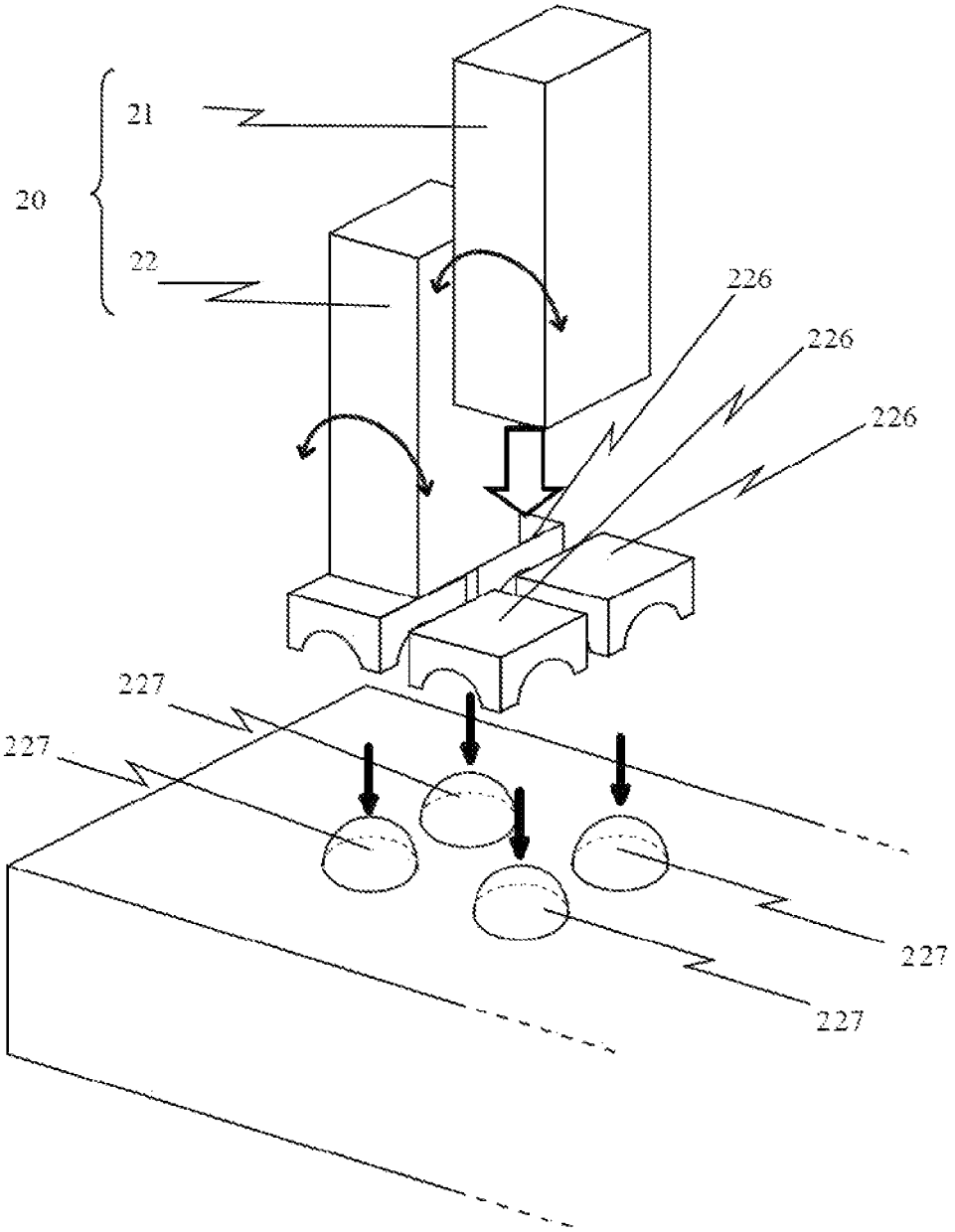
FIG. 9 is a schematic perspective view of a rocking mechanism unit according to Example 5.

FIG. 9 is a schematic perspective view of a rocking mechanism unit 225 according to Example 5.

The liquid material ejection device 1 according to Example 5 is different from Example 1 in that the rocking mechanism unit 225 is constituted by four connection portions 226 and four support portions 227. The other constitution is similar to that in Example 1.

The four connection portions 226 are each a member including a recess (i.e., a semispherical dent) formed in its lower surface and defined by a smooth curved surface, and are arranged in a matrix pattern of 2×2. The actuators (21, 22) are each arranged in a state straddling the two connection portions 226 that are arranged side by side in a direction perpendicular to the longitudinal direction of the arm 30. Unlike the above arrangement, four actuators may be disposed in a one-to-one relation to the four connection portions 226. Alternatively, one among the three actuators may be disposed in a state straddling the two connection portions 226, and the other two actuators may be disposed in a one-to-one relation to the two connection portions 226.

An upper surface of each support portion 227 is formed by a smooth curved surface (e.g., a surface of a semispherical boss) having the same curvature as that of the recess in the connection portion 226.

With the rocking mechanism unit 225, the connection portions 226 are caused to slide and move in the longitudinal direction of the arm 30, thus enabling the arm driver 20 and the arm 30 to be inclined relative to the base member 10 (i.e., to be moved in directions denoted by two arrows in FIG. 9).

Furthermore, since an upper surface of the connection portion 226 has a larger area, an actuator having a larger size than that in Example 1 can be mounted.

Similar operational effects to those in Example 1 can also be realized with the above-described liquid material ejection device 1 according to Example 5.

LIST OF REFERENCE SIGNS

1: liquid material ejection device, 10: base member, 11: upper surface (of base member), 12: bottom surface (of base member), 13: recess, 14: plunger insertion hole, 20: arm driver, 21: first actuator, 22: second actuator, 25: rocking mechanism unit, 26: connection portion, 27: support portion, 30: arm, 31: upper surface (of arm), 32: bottom surface (of arm), 33: arm rod (pressing member), 34: pressing portion, 35: fastener, 41: guide, 42: sealing member, 50: plunger, 51: rod portion (of plunger), 52: tip portion (of plunger), 53: rear end (contact portion) (of plunger), 54: elastic member, 60: liquid feed member, 61: supply passage, 62: supply port, 63: inflow passage, 64: air purging passage, 65: joint, 66: closing plug, 70: nozzle unit, 71: nozzle member, 72: valve seat, 73: cap, 74: liquid chamber 75: ejection port, 100: application apparatus, 101: bench, 102: workpiece, 103: worktable, 104: application operation control unit, 111: X-axis driver, 112: Y-axis driver, 113: Z-axis driver, 121: X direction, 122: Y direction, 123: Z direction, 125: rocking mechanism unit, 126: connection portion, 127: support portion, 225: rocking mechanism unit, 225; connection portion, 227: support portion

The invention claimed is:

1. A liquid material ejection device comprising:

a liquid chamber communicating with an ejection port and being supplied with a liquid material;

a plunger including a tip portion that has a smaller diameter than the liquid chamber and is moved back and forth in the liquid chamber;

an elastic member urging the plunger upward;

an arm disposed in a state extending in a horizontal direction;

an arm driver serving as a driving source to operate the arm;

a base member on which the arm driver is disposed; and a fastener rockingly supporting the arm to the base member, wherein the liquid material ejection device further comprises a rocker connected to the arm driver and rockingly supporting the arm, the arm driver includes a plurality of actuators disposed in a juxtaposed relation in a longitudinal direction of the arm, each of the actuators being extended and contracted in a direction perpendicular to the longitudinal direction of the arm to cause a rocking motion of the arm, the arm includes a presser pressing the plunger downward, the plunger includes a contact portion pressed by the presser, the plunger is linearly reciprocated with the rocking motion of the arm, and wherein the contact portion of the plunger and the presser are not interlocked with each other such that the presser slides in the horizontal direction of the extending direction of the arm relative to the contact portion of the plunger during the rocking motion of the arm, wherein the plurality of actuators comprises a first and a second actuators, wherein the rocker includes a first connection portion connected to one end of the first actuator, a second connection portion connected to one end of the second actuator, a first support portion rockingly supporting the first connection portion and a second support portion rockingly supporting the second connection portion, and wherein the fastener is a rod-like shaped and is disposed to have a longitudinal axis parallel to a longitudinal direction of the first and second actuators.

2. The liquid material ejection device according to claim 1, wherein the plurality of actuators are each constituted by a multilayered piezoelectric element, a side of the arm where the presser is disposed is moved upward when one of the plurality of actuators disposed on a side thereof, nearer to the presser, is brought into an extended state and an other of the plurality of actuators disposed on the side thereof, farther away from the presser, is kept in a non-extended state or brought into a contracted state, and the side of the arm where the presser is disposed is moved downward when the one of the plurality of actuators disposed on the side thereof, nearer to the presser, is kept in the non-extended state or brought into the contracted state and the other of the plurality of actuators disposed on the side thereof, farther away from the presser, is brought into the extended state.

3. The liquid material ejection device according to claim 2, wherein the plurality of actuators are constituted by an even number of the actuators.

4. The liquid material ejection device according to claim 3, wherein the even number of the actuators are constituted by a first piezoelectric actuator and a second piezoelectric actuator.

5. The liquid material ejection device according to claim 1, wherein the presser has a protruding curved surface which protrudes toward the contact portion and which faces and contacts an end surface of the contact portion to allow a contact state between the presser and the contact portion to be maintained following the rocking motion of the arm, or the contact portion has a protruding curved surface which protrudes toward the presser and which faces and contacts an end surface of the presser to allow a contact state between the presser and the contact portion to be maintained following the rocking motion of the arm.

6. The liquid material ejection device according to claim 1, wherein the fastener detachably and rockingly supports the arm to the base member.

7. The liquid material ejection device according to claim 6, wherein the fastener is disposed between the plurality of actuators, and the plurality of actuators are sandwiched between the arm and the base member by the fastener.

8. The liquid material ejection device according to claim 1, further comprising a guide supporting the plunger movably in a vertical direction, wherein the elastic member is a compressed coil spring urging the plunger upward at all times, and the plunger is detachably inserted through the elastic member and the guide.

9. The liquid material ejection device according to claim 1, wherein the rocker is connected to a lower end of the arm driver, or connected to an upper end of the arm driver.

10. The liquid material ejection device according to claim 1, wherein the rocker includes a first rocker connected to a lower end of the arm driver and a second rocker connected to an upper end of the arm driver.

11. The liquid material ejection device according to claim 1, wherein the first support portion has a convex or concave support surface that is formed by a smooth curved surface, and the first connection portion has a concave or convex sliding surface that slides along the support surface of the first support portion.

12. The liquid material ejection device according to claim 1, wherein the second support portion has a convex or concave support surface that is formed by a smooth curved surface, and the second connection portion has a concave or convex sliding surface that slides along the support surface of the second support portion.

13. The liquid material ejection device according to claim 1, wherein the presser is constituted by a pressing member detachably attached to the arm.

14. The liquid material ejection device according to claim 1, wherein the plurality of actuators are all arranged under the arm.

15. An application apparatus comprising the liquid material ejection device according to claim 1, a worktable on which an application target is placed, a relatively moving device that moves the liquid material ejection device and the application target relatively to each other, and a liquid material supply source that supplies a liquid material to the liquid material ejection device.

16. The application apparatus according to claim 15, wherein the liquid material ejection device is constituted by a plurality of the liquid material ejection devices.

17. The liquid material ejection device according to claim 1, wherein the arm driver is disposed between the arm and the base member, and the rocker is disposed between the arm driver and the base member.

18. The liquid material ejection device according to claim 1, wherein the arm presses the plunger downward but does not press the plunger upward.

19. The liquid material ejection device according to claim 1, wherein a contact position and a contact angle of the presser relative to the contact portion of the plunger vary depending on a vertical position of the presser during the rocking motion of the arm.

* * * * *